343-700 MS AU 256 EX
3/16/82 OR 4,320,401

United States Patent [19]

Schiavone

Fig 3

[11] 4,320,401

[45] Mar. 16, 1982

[54] BROADBAND MICROSTRIP ANTENNA WITH AUTOMATICALLY PROGRESSIVELY SHORTENED RESONANT DIMENSIONS WITH RESPECT TO INCREASING FREQUENCY OF OPERATION

[75] Inventor: Frank J. Schiavone, Longmont, Colo.

[73] Assignee: Ball Corporation, Muncie, Ind.

[21] Appl. No.: 121,885

[22] Filed: Feb. 15, 1980

Related U.S. Application Data

[62] Division of Ser. No. 906,665, May 16, 1978, Pat. No. 4,259,670.

[51] Int. Cl.[3] ..... H01Q 1/38
[52] U.S. Cl. ..... 343/700 MS; 343/722
[58] Field of Search ..... 343/700 MS, 705, 708, 343/829, 830, 846, 722

[56] References Cited

U.S. PATENT DOCUMENTS

| | | | |
|---|---|---|---|
| 2,996,713 | 8/1961 | Boyer | 343/700 MS |
| 3,541,557 | 11/1970 | Miley | 343/700 MS |
| 3,680,136 | 7/1972 | Collings | 343/700 MS |
| 3,987,455 | 10/1976 | Olyphant | 343/700 MS |
| 4,053,895 | 10/1977 | Malagisi | 343/700 MS |
| 4,074,270 | 2/1978 | Kaloi | 343/700 MS |
| 4,167,010 | 9/1979 | Kerr | 343/700 MS |
| 4,170,012 | 10/1979 | Kaloi | 343/700 MS |

*Primary Examiner*—Eli Lieberman
*Attorney, Agent, or Firm*—Nicholas T. Bokides

[57] ABSTRACT

Variable impedance devices (e.g., series resonant circuits and/or transmission line tuning stubs) are connected to predetermined locations on a microstrip radiator patch for effectively changing the effective resonant dimensions of the antenna as a function of frequency and thereby permitting effective operation over a broad range of frequencies.

11 Claims, 10 Drawing Figures

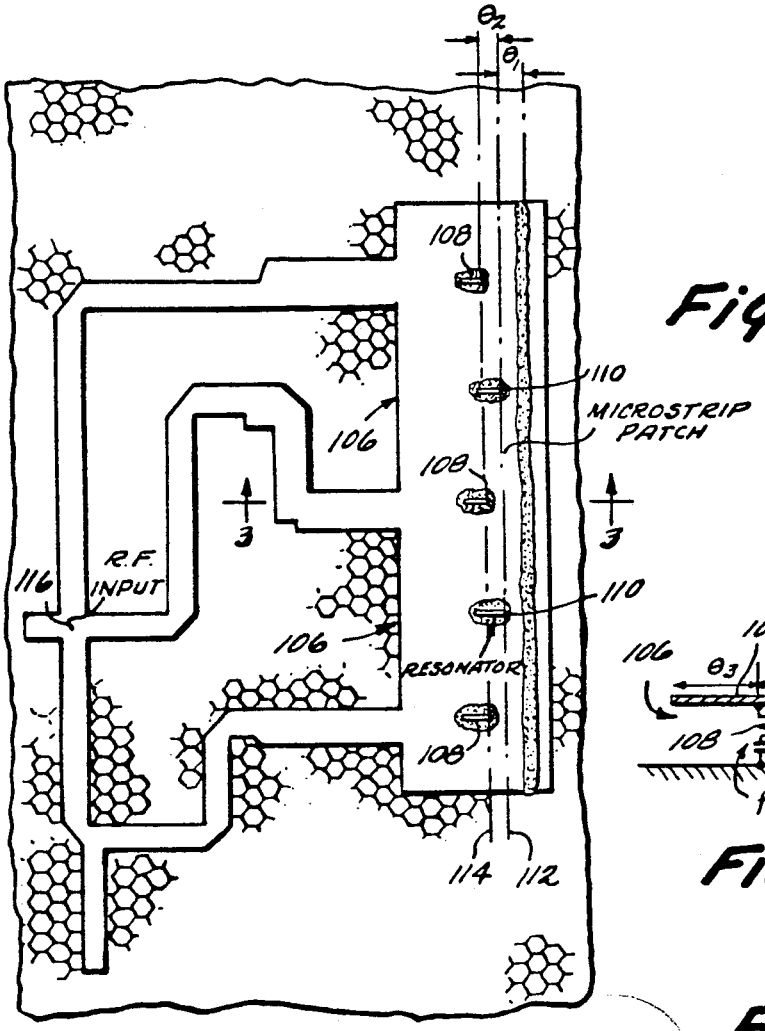
Fig. 2
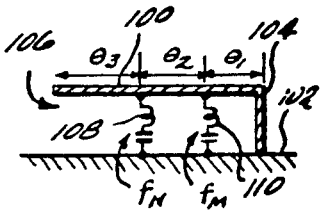
Fig. 1
Fig. 3
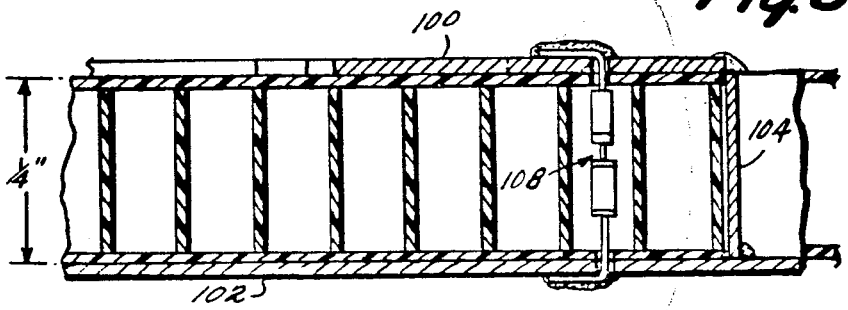

E-PLANE PATTERN
AT 800 MHZ
$\phi=0$

E-PLANE PATTERN
AT 1800 MHZ
$\phi=0$

E-PLANE PATTERN
AT 1400 MHZ
$\phi=90°$

H-PLANE PATTERN (TYPICAL AT 800-1800 MHZ) TAKEN AT 800 MHZ

BROADBAND MICROSTRIP ANTENNA WITH AUTOMATICALLY PROGRESSIVELY SHORTENED RESONANT DIMENSIONS WITH RESPECT TO INCREASING FREQUENCY OF OPERATION

This is a division of application Ser. No. 906,665 filed May 16, 1978, now U.S. Pat. No. 4,259,670.

This invention relates generally to antennas of the microstrip type. However, whereas most known microstrip structures are capable of only relatively narrow band operation, this microstrip antenna exhibits broadband capabilities. For example, a single antenna element may be operated over more than a complete octave of frequencies with relatively stable and efficient operating characteristics.

Microstrip antenna elements, per se, are now well-known in the art. They are especially advantageous for many applications because of their extreme conformability, relatively light-weight and rugged structure and many other desirable characteristics. However, individual microstrip elements have traditionally been usable only over relatively narrow frequency bandwidths which thus prevent them from being used for many commercial and/or military systems which require broadband operations. For example, prior microstrip elements have typically provided only approximately 2–5 percent frequency bandwidth for operation at less than a two to one VSWR.

As is well-known and understood, a microstrip antenna is a device (usually printed circuit) in which a resonant conductive radiating "patch" (usually having an extended two dimensional area with at least one dimension being substantially equal to a resonant 0.25 or 0.50 wavelength) is closely spaced (usually less than one-twentieth wavelength) above an underlying ground plane. As is also well-known and understood, the microstrip antenna is a narrow band device which is usually considered to operate at substantially a single resonant frequency. The VSWR bandwidth of a typical microstrip antenna is increased by increasing the spacing of its "patch" above the ground plane; however, other desired microstrip antenna qualities can be degraded by such increased spacing. In the past this has resulted, for practical purposes, in an actual practicably realizable VSWR bandwidth of only approximately 2–5% or so of the nominal center frequency of operation. Hence, the reputation as a very narrow bandwidth (high Q) antenna.

This basic disadvantage has been recognized in the art. One technique used in the past for alleviating this disadvantage was to provide multiple antenna structures resonant at respectively corresponding frequencies or to provide individual antenna radiators having multiple resonant dimensions or the like. In this manner, several discrete narrow band frequencies of operation could be accomodated. For example, other microstrip radiator structures including some multiple resonant microstrip radiators have been disclosed in commonly assigned U.S. Pat. Nos. 3,713,162 issued Jan. 23, 1973; 3,810,183 issued May 7, 1974; 3,811,128 issued May 14, 1974; 3,921,177 issued Nov. 18, 1975; 4,070,676 issued Jan. 24, 1978; and U.S. patent application Ser. No. 620,272 filed Oct. 7, 1975.

Another multiple frequency microstrip antenna assembly is described in U.S. Pat. No. 4,074,270 issued Feb. 14, 1978 to Kaloi. This patent essentially provides an assemblage of different antennas tuned to different operating frequencies. Although provision is made for a variable capacitor located at the corners of certain elements to tune the elements slightly about a center frequency of operation, the resulting individual microstrip radiators are still very narrow band divices. For example, Kaloi indicates that the button-like capacitor employed in the corner of certain elements permits them to be tuned over a "small arrange of frequencies" said to be approximately ±1.5 MHz.

Now, however, it has been discovered that the typical microstrip antenna element may be modified so as to achieve broadband operation. In essence, means are connected to the radiator patch for progressively electrically shortening the resonant dimensions of the antenna for higher frequency electrical signals supplied thereto. For example, variable impedance means (e.g., series resonant circuits and/or transmission line tuning stubs) are connected to predetermined locations on the radiator patch for effectively changing the resonant dimensions of the patch and permitting effective operation over a much broader range of frequencies.

In the preferred exemplary embodiment, the variable impedance means are automatically responsive to the frequency of applied electrical signals. Such automatically responsive means may take the form of discrete inductive and capacitive elements connected in series resonant circuits and/or transmission line tuning stubs having predetermined electrical lengths and terminations.

In the preferred exemplary embodiment, the radiator patch is generally rectangular having one longitudinal edge effectively shorted to the underlying ground plane surface while the other opposing edge is left open circuited to define a radiating aperture for the included cavity at a relatively low frequency corresponding to the distance between the two longitudinal edges of the patch. A first plurality of the variable impedance means are then connected at spaced apart locations along a first path generally parallel to these longitudinal edges and spaced from the radiating aperture so as to define a resonant cavity at a first higher frequency of operation. At this higher resonant frequency, the variable impedance means will present effective short circuits at their connection points between the radiating patch and the underlying ground plane. Thus, in effect, the active resonant dimensions of the antenna will be different for such higher frequencies than for the lower frequencies at which only the opposite edge presents a substantial short circuit. Furthermore, in the preferred exemplary embodiment, a second plurality of variable impedance means is connected at spaced-apart locations along a second path which is again substantially parallel to the radiating aperture and spaced therefrom so as to define a third resonant dimension corresponding to a third intermediate frequency of antenna operation.

Using this preferred exemplary embodiment, there are thus three different effective resonant dimensions corresponding to a high, intermediate, and low frequency of antenna operation. Successful antenna operation over a complete octave of frequencies has been achieved using such techniques. If more or less sets of variable impedance means are connected so as to define resonant dimensions, successful operation should be achieved over corresponding greater or smaller bandwidths respectively.

These and other features of this invention will be more completely appreciated by reading the following detailed description taken in conjunction with the accompanying drawings, of which:

FIG. 1 is a schematic cross-sectional depiction of an exemplary embodiment of this invention;

FIG. 2 is a plan view of an exemplary embodiment of this invention utilizing discrete components as resonators;

FIG. 3 is a partial cross-sectional view of the embodiment shown in FIG. 2;

Figure 4:
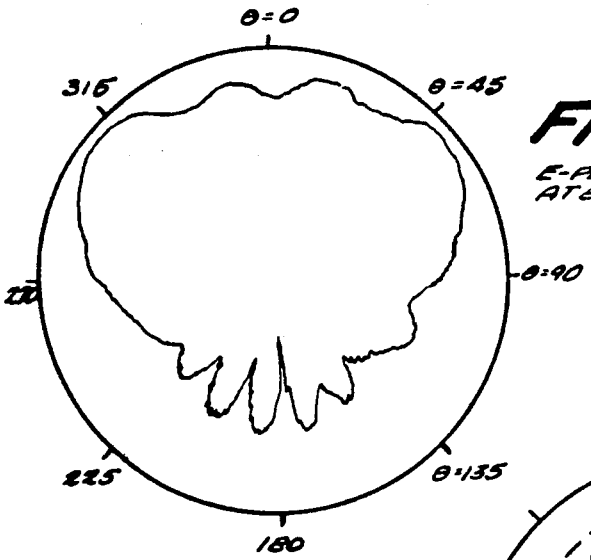
FIGS. 4–7 are various radiation patterns taken during operation of the embodiment in FIG. 2.

One type of microstrip radiator has a free edge defining a radiating aperture which is located one-fourth wavelength from a shorted edge or portion of the radiating patch. This general type of microstrip radiator is depicted in cross-section at FIG. 1. Here, a radiator patch 100 is spaced over an underlying conductive ground plane or reference surface 102. Typically, the patch is spaced at considerably less than one-fourth wavelength from the underlying ground plane. Furthermore, the patch 100 is usually spaced from the ground plane 102 by a solid or expanded dielectric material. As shown in the exemplary embodiments herein, the dielectric is shaped in a honeycomb fashion so as to be approximately equivalent to the included air therewithin.

The radiator patch 100 shown in FIG. 1 is shorted at 104 to the underlying ground plane. The cavity included then between the shorted edge 104 and the free edge defining radiating aperture 106 is substantially one-fourth wavelength at the normal microstrip antenna operating frequency. In other words, the dimensions $\theta_1+\theta_2+\theta_3$ would equal substantially one-fourth wavelength at an operating frequency $F_L$.

In the usual microstrip antenna structure, the antenna would operate efficiently only at frequency $F_L$ or within approximately 2–5 percent of that intended operating frequency. However, in the modified broadband structure shown in FIG. 1, a series resonant circuit 108 and another series resonant circuit 110 have been connected at predetermined locations on the radiator patch. When these series resonant circuits resonate, they will present an effective short circuit to the underlying ground plane at that particular location. In this way, the effective resonant dimensions of the antenna cavity are changed as a function of the frequency of the electrical signal supplied to the antenna structure.

Since resonant circuit 108 is connected nearest the radiating aperture 106, it is tuned to resonant at the highest operation frequency $F_H$ while the intermediately located resonant circuit 110 is tuned to resonant at an intermediate frequency $F_M$. The predetermined locations from the radiating aperture 106 are selected such that $\theta_3$ is equal to approximately one-fourth wavelength at operating frequency $F_H$ while $\theta_2+\theta_3$ is equal to approximately one-fourth wavelength at an operating frequency of $F_M$. If the microstrip radiator patch 100 is square or rectangular in shape, then a number of resonator circuits 108, 110 will be spaced along corresponding paths parallel to the radiating aperture 106.

While in theory one would like to have a large number of such resonant circuits along a given path, practicalities require that the number of such resonant circuits spaced along a given path be minimized consistent with satisfactory performance. It has been discovered that satisfactory performance is achieved if the spacing is such that the impedance at points between the actual locations of resonant circuits along the path at the resonant frequency of the resonant circuits never exceeds approximately 30–50 ohms.

It should also be appreciated that this technique of changing the effective resonant dimensions of a microstrip antenna structure by utilizing variable impedance means effectively connected between the radiator patch and the underlying ground plane at predetermined locations may be used with other forms of microstrip antenna structures than the quarter-wave shorted edge version depicted in FIG. 1.

The embodiment shown in FIG. 2 was actually constructed and successfully operated. The basic microstrip structure was designed for operation at 1 GHz. High frequency operation was designed with $F_H$ equal to 2 GHz and although a 1.5 GHz mid-frequency $F_M$ was desired, due to inaccuracies in construction, a mid-frequency of approximately 1.2 GHz actually resulted. In terms of spacing from the shorted edge 104, $\theta_1$ was equal to approximately 0.209 inches while $\theta_1+\theta_2$ was equal to approximately 0.293 inches. Discrete element series resonant circuits 110 were then connected between the radiator patch 100 and the underlying ground plane surface 102 at spaced-apart locations along line 112 which is generally parallel to both the radiating aperture 106 and the shorted edge 104. Similarly, discrete element series resonant circuits 108 were connected at spaced-apart locations along line 114 which is similarly oriented. In this exemplary embodiment, the resonant circuits 110 comprise lumped inductances of approximately 60 nano henries and capacitances of approximately 0.13 pico farads. Similarly, the resonant circuits 108 comprise lumped inductances of approximately 51 nano henries and lumped capacitances of approximately 0.11 pico farads. RF energy was fed from a common RF input 116 through a conventional corporate microstrip feedline to the free edge of the radiator patch 100 as seen in FIG. 2.

An enlarged partial cross-section of the embodiment in FIG. 2 is shown at FIG. 3. As seen therein, the total thickness of the honeycomb and air dielectric structure is approximately one-fourth inch and the radiator patch 100 is spaced above the underlying ground plane 102 by that amount.

Figure 4A:
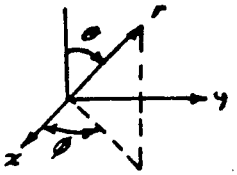
Figure 5:
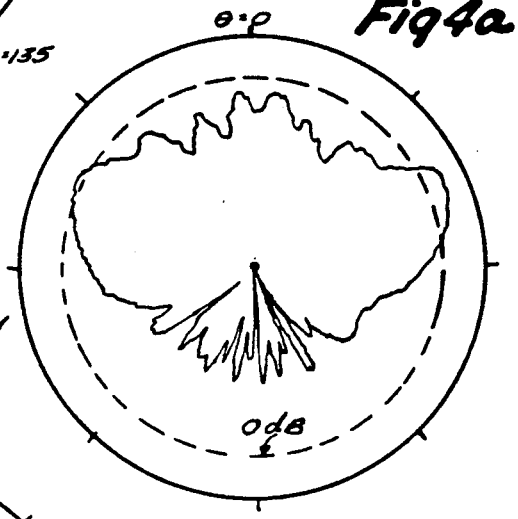
Figure 6:
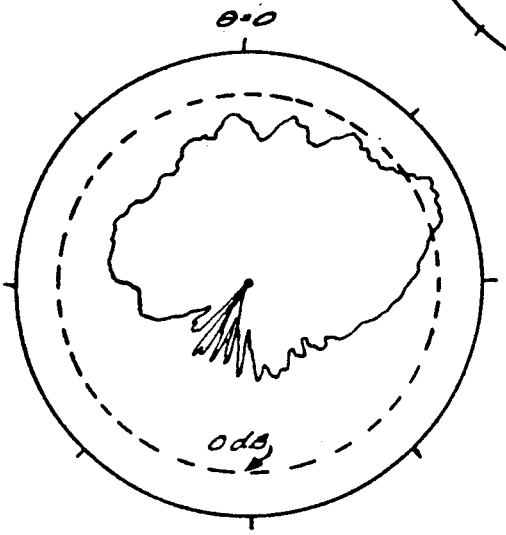
Figure 7:
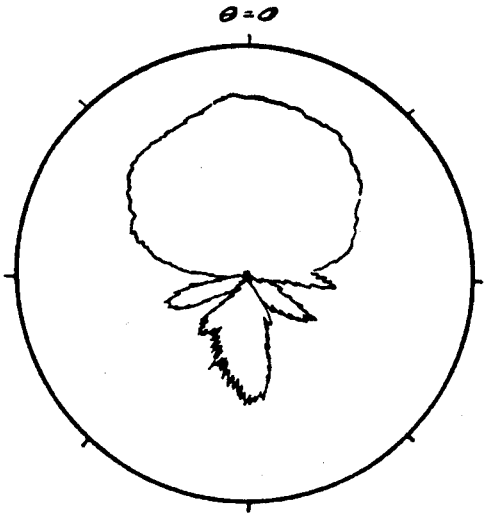

The patterns in FIGS. 4, 5 and 6 are all of the E-plane for the antenna shown in FIG. 2. Using the frame of reference shown in FIG. 4A, the microstrip antenna of FIG. 2 was mounted in the x, y plane facing the positive x axis. For $\phi$ equal to 0°, the E-plane pattern is shown for operation at 800 MHz for $\theta$ varying from 0° through 360°. A similar E-plane pattern is shown in FIG. 5 for operation at 1800 MHz, more than one octave higher in frequency. The E-plane pattern shown in FIG. 6 was taken for $\phi$ equal to 90°, operation at 1400 MHz and $\theta$ varying from 0° to 360°. Finally, the H-plane pattern shown in FIG. 7 is typical for operation throughout 800–1800 MHz although the particular pattern shown in FIG. 7 was taken at 800 MHz.

Figure 8:
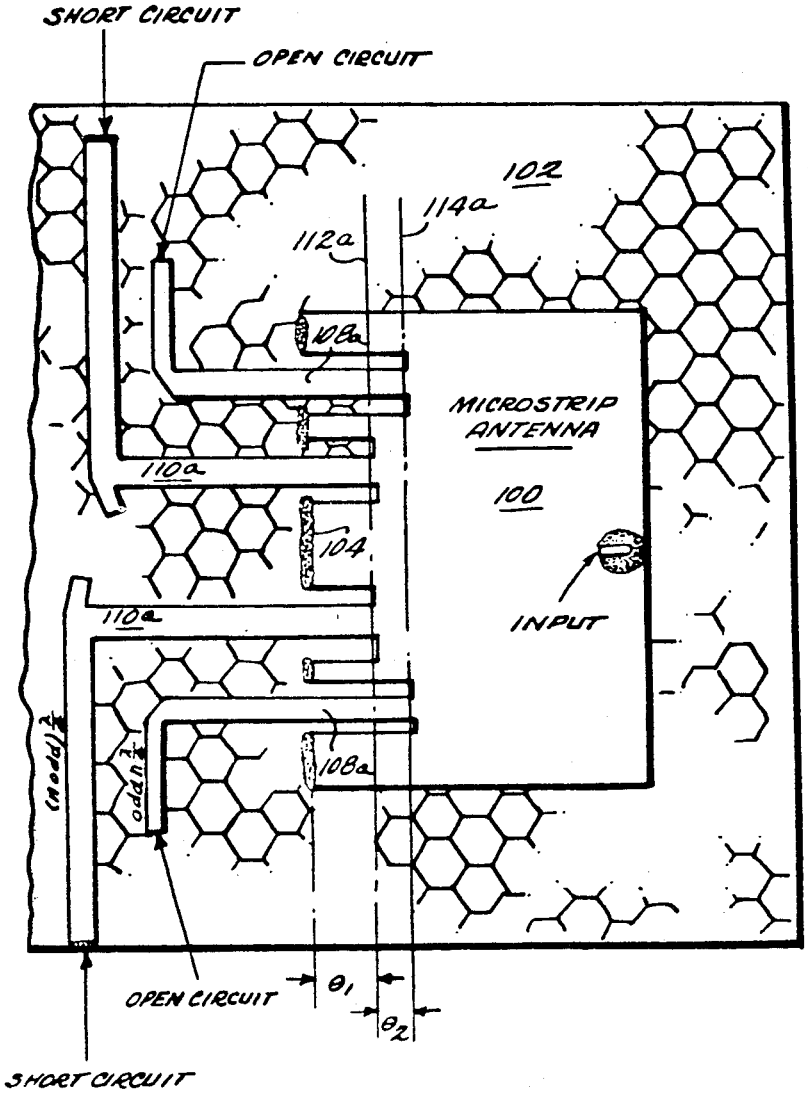
FIG. 8 is a plan view of yet another exemplary embodiment utilizing transmission line tuning stubs rather than discrete components.

Another embodiment similar to that of FIG. 2 is shown in FIG. 8. However, in FIG. 8, the discrete element series resonant circuits have been replaced with corresponding transmission line tuning stubs. Transmission lines 108A are connected along path **114*a* similar to the connection of resonant circuits 110 along path 114 in FIG. 2. In addition, transmission line elements 110A are connected at points spaced-apart along path 112***a* similar to the connection of the resonant circuits 110 along path 112 in FIG. 2.

In the particular exemplary embodiment shown in FIG. 8, transmission lines 108A are open-circuited at their extremities and are odd multiples of one-fourth wavelengths at the highest operating frequency $F_H$. Transmission lines 110A are short circuited at their extremities and are multiples of one-half wavelength at the mid-frequency $F_M$. The function of these transmission lines which have predetermined electrical lengths and electrical terminations is exactly analogous to the function of the discrete series resonant circuits already discussed with respect to FIG. 2. In particular, the effective resonant dimensions of the microstrip antenna 100 are varied at different operating frequencies where these transmission lines act effectively as short circuits to the underlying ground plane surface. RF energy is fed into the microstrip antenna radiator patch 100 near the free or radiating edge aperture at a point selected for a correct impedance match as will be appreciated by those in the art.

Figure 9:
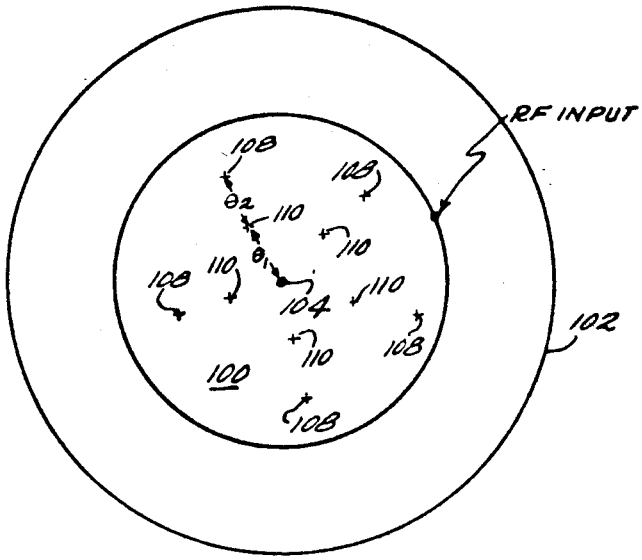
FIG. 9 is a plan view of yet another exemplary embodiment utilizing a circularly shaped radiation patch rather than a square or rectangularly shaped patch.

The microstrip patches discussed with respect to FIGS. 2–8 are rectangular or square in shape and thus provide the usual dipole type of radiation pattern. However, the same type of modified broadband operation may be obtained with other forms of microstrip radiator patches. For example, as shown in FIG. 9, a circularly shaped radiator patch 100 which provides the usual monopole type of radiation pattern may also provide broadband operation when modified according to this invention. As shown in FIG. 9, the circular radiator patch is grounded at 104 and has a radius which is approximately one-fourth wavelength at the lowest operation frequency $F_L$. RF energy is conventionally fed to the patch such as at the RF input shown in FIG. 9. Variable impedance means 110 are located at spaced apart locations at a radius $\theta_1$ so as to effectively change the resonant dimensions of the patch when these elements become effective short circuits to the underlying ground plane 102. Similarly, variable impedance means 108 are connected at spaced apart locations at radius $\theta_1+\theta_2$ which perform a similar function at a higher operating frequency $F_H$.

As of the present time, only two sets of variable impedance means 108 and 110 have been utilized as described above. However, the inclusion of additional sets of variable impedance means spaced at different distances from the radiating aperture should correspondingly increase the broadband capabilities of the microstrip radiator. Similarly, the use of a single set of variable impedance means should produce a considerably broadened band microstrip antenna operation although probably not as broadband as when two sets of variable impedance means are utilized as in the above explained exemplary embodiments.

Although this invention has been explained with reference to only a few exemplary embodiments, those skilled in the art will appreciate that many modifications of these exemplary embodiments are possible without departing from the novel and advantageous features of this invention as defined in the attached claims.

What is claimed is:

1. An improved microstrip antenna of the type which includes a resonant-dimensioned conductive radiator patch closely spaced over an underlying conductive surface and otherwise normally exhibiting a narrow VSWR bandwidth of only approximately 2–5%, said improved antenna comprising:

a plurality of frequency responsive impedance means connected to the radiator patch at predetermined locations along a predetermined path to automatically and progressively change the effective resonant dimensions of the cavity defined between at least one edge of the patch, said predetermined path and the underlying surface for signals of differing frequencies thereby automatically providing efficient antenna operation over a frequency bandwidth which is substantially greater than the otherwise expected bandwidth of only approximately 2–5 percent for operation at less than a two-to-one VSWR.

2. An improved antenna as in claim 1, wherein said impedance means comprises a series resonant circuit of discrete inductive and capacitive elements connected between the radiator patch and the underlying surface.

3. An improved antenna as in claim 1 wherein said impedance means comprises a transmission line having a predetermined electrical length at a predetermined frequency and a predetermined electrical termination at one end, the other end of said transmission line being electrically connected to said radiator patch at one of said locations.

4. An improved antenna as in any of claims 1, 2 or 3 wherein said plurality of impedance means are each connected to respectively corresponding spaced-apart locations on the radiator patch thereby defining first resonant dimensions for said cavity at a predetermined first frequency.

5. An improved antenna as in claim 4 comprising a further plurality of said impedance means, each being connected to respectively corresponding spaced-apart further locations on the radiator patch and thereby defining second resonant dimensions for said cavity at a predetermined second frequency.

6. An improved antenna as in claim 4 wherein:

one portion of the radiator patch is electrically shorted to the underlying surface while an edge is left open-circuited to define a radiating aperture, and said spaced-apart locations substantially lie on a path parallel to said edge and spaced therefrom by a first predetermined amount.

7. An improved antenna as in claim 5 wherein:

one portion of the radiator patch is electrically shorted to the underlying surface while an edge is left open-circuited to define a radiating aperture;

said spaced-apart locations lie on a first path substantially parallel to said edge and spaced therefrom by a first predetermined amount; and said spaced-apart further locations lie on a second path substantially parallel to said edge and spaced therefrom by a second predetermined amount.

8. An improved antenna as in claim 7 wherein:

the distance from said edge to said first path is substantially equal to one-fourth wavelength at a first high frequency where the respectively corresponding impedance means are responsive;

the distance from said edge to said second path is substantially equal to one-fourth wavelength at a second medium frequency where the respectively corresponding impedance means are responsive; and the distance from said edge to said shorted portion is substantially equal to one-fourth wavelength at a third low frequency whereby the antenna is made capable of effective operation over a range of frequencies extending from said low to said high frequency.

9. An improved antenna as in claim 1 wherein said patch is substantially square or rectangular in shape.

10. An improved antenna as in claim 1 wherein said patch is substantially circular in shape.

11. A broadband microstrip antenna comprising:

a resonant-dimensioned conductive radiator patch closely spaced over an underlying conductive surface; and a plurality of separate means connected to the radiator patch at respectively predetermined locations along plural predetermined paths for automatically and progressively electrically shortening the resonant dimensions of the antenna along successive ones of said paths for higher frequency electrical signals supplied to/from the radiator patch thereby automatically simultaneously providing efficient antenna operation over a frequency bandwidth which is substantially greater than the otherwise expected bandwidth of only approximately 2–5 percent for operation at less than a two-to-one VSWR.

* * * * *